US011952717B2

(12) United States Patent
Eberhardt et al.

(10) Patent No.: US 11,952,717 B2
(45) Date of Patent: Apr. 9, 2024

(54) BASIC STRUCTURE OF A CLOTHING FOR A MACHINE FOR PRODUCING OR PROCESSING A FIBROUS MATERIAL WEB AND METHOD FOR THE PRODUCTION THEREOF

(71) Applicant: VOITH PATENT GMBH, Heidenheim (DE)

(72) Inventors: Robert Eberhardt, Ellwangen (DE); Susanne Klaschka, Cologne (DE)

(73) Assignee: Voith Patent GmbH, Heidenheim (DE)

( * ) Notice: Subject to any disclaimer, the term of this patent is extended or adjusted under 35 U.S.C. 154(b) by 159 days.

(21) Appl. No.: 17/633,661

(22) PCT Filed: Jul. 3, 2020

(86) PCT No.: PCT/EP2020/068860
§ 371 (c)(1),
(2) Date: Feb. 8, 2022

(87) PCT Pub. No.: WO2021/028116
PCT Pub. Date: Feb. 18, 2021

(65) Prior Publication Data

US 2022/0298727 A1 Sep. 22, 2022

(30) Foreign Application Priority Data

Aug. 9, 2019 (DE) ..... 10 2019 121 465.8

(51) Int. Cl.
*D21F 7/10* (2006.01)
*D21F 7/08* (2006.01)

(52) U.S. Cl.
CPC ..... *D21F 7/10* (2013.01); *D21F 7/083* (2013.01)

(58) Field of Classification Search
CPC ... D21F 7/10; D21F 7/083; D21F 7/08; D21F 7/12; D21F 1/0027; D21F 1/0036; D21F 1/0045; D21F 1/0054
(Continued)

(56) References Cited

U.S. PATENT DOCUMENTS 11,072,889 B2 7/2021 Malmquist et al.
2009/0090425 A1* 4/2009 Hawes ..... D21F 7/083 139/383 AA
(Continued)

FOREIGN PATENT DOCUMENTS

DE 102016204418 A1 4/2017
DE 102016111769 A1 12/2017
(Continued)

*Primary Examiner* — Eric Hug
(74) *Attorney, Agent, or Firm* — Laurence A. Greenberg; Werner H. Stemer; Ralph E. Locher

(57) ABSTRACT

A basic structure of a clothing for a machine for producing or processing a fibrous web, in particular a paper, cardboard or tissue web. The basic structure has at least a first flat fabric of fabric type A and a second flat fabric of fabric type B, and, furthermore, two loop elements. The loop elements are formed in each case from a flat fabric piece which has a first portion of fabric type A and a second portion of fabric type B. The first portion is laid down on the second portion in such a way that the folding point is formed at a spacing of less than 5 cm, in particular less than 1 cm, from the changeover position between the fabric type A and the fabric type B. The first and the second flat fabric are arranged above one another, and the two loop elements are arranged in each case at a face-side, front end.

20 Claims, 4 Drawing Sheets

(58) Field of Classification Search
USPC ..... 162/358.2, 348, 900, 902–904
See application file for complete search history.

(56) References Cited

U.S. PATENT DOCUMENTS

| | | | | |
|---|---|---|---|---|
| 2019/0194869 | A1* | 6/2019 | Malmquist | E04H 1/04 |
| 2022/0228317 | A1* | 7/2022 | Klaschka | D21F 3/045 |

FOREIGN PATENT DOCUMENTS

| | | | | |
|---|---|---|---|---|
| EP | 0425523 | B1 | | 3/1995 |
| EP | 2788546 | B1 | | 1/2018 |
| WO | WO 2013/083468 | | * | 6/2013 |

* cited by examiner

BASIC STRUCTURE OF A CLOTHING FOR A MACHINE FOR PRODUCING OR PROCESSING A FIBROUS MATERIAL WEB AND METHOD FOR THE PRODUCTION THEREOF

FIELD AND BACKGROUND OF THE INVENTION

The invention relates to the basic structure of a clothing for a machine for producing or processing a fibrous material web, in particular a paper, cardboard or tissue web, comprising at least one first flat woven fabric of woven fabric type A and one second flat woven fabric of woven fabric type B.

Clothings for paper machines or similar equipment often have a basic structure which imparts stability to the clothing and takes up forces, in particular tensile forces, which act on the clothing during operation of the equipment. A large proportion of the basic structures used nowadays consist entirely or partially of woven fabrics.

One conventional method for producing the endless fabric loops required is circular weaving. In this case, the endless structure is produced directly on the loom itself and does not have a seam. However, circular weaving is very slow and elaborate as a production method. Furthermore, it is already necessary to know accurately during the weaving how long the desired clothing is intended to be. Since each position of use in a paper machine requires a very individual length of the clothing loop, production of such basic structures is respectively possible only for a specific order.

As an alternative which overcomes these two difficulties, it was already proposed some time ago to produce seam clothings on the basis of flat woven fabrics. These are described, for example, in EP 0 425 523 or EP 2 788 546. In this case, in a flat woven fabric, the ends are placed on themselves so that a two-layer textile is formed. The fold locations may be formed by removing CD threads—which correspond to the weft threads in the loom—to create seam loops. The two front ends of the double-layer textile may be connected by making the seam loops engage in one another and connecting them by means of a pintle wire.

This concept has proven highly successful in recent years since it makes it possible to produce the flat woven fabric rapidly and store it on rolls. When the order comes in, the desired length is taken off these rolls and it is furthermore shortened to the required width.

For some applications, however, it is found disadvantageous that this concept is relatively inflexible. The two layers of the two-layer textile respectively consist of the same woven fabric. This leads on the one hand to so-called Moiré effects due to the superposition. On the other hand, the different requirements on the backing side and the paper side cannot be taken into account.

In order to avoid these problems, DE102016111769 proposes to modify the weaving pattern of the flat woven fabric during the weaving process, in such a way that the two layers of the two-layer textile respectively have a different weaving pattern. Although Moiré effects may thereby be reduced, the changeover of the weaving pattern must respectively take place at the fold location, so that here again the length of the clothing must already be known during the production of the basic structure.

SUMMARY OF THE INVENTION

It is therefore an object of the present invention to overcome the problems of the prior art.

In particular, it is an object of the present invention to provide a basic structure and its production method, which both allows great flexibility in the design of the clothing and the components of which to nevertheless be able to be produced substantially independently of the dimensions of the clothing.

These objects are entirely achieved by a basic structure according to the claims and by a method for producing a basic structure as claimed.

Advantageous embodiments are described in the dependent claims.

In respect of the basic structure, the object is achieved by a basic structure of a clothing for a machine for producing or processing a fibrous material web, in particular a paper, cardboard or tissue web. The basic structure comprises at least one first flat woven fabric of woven fabric type A and one second flat woven fabric of woven fabric type B. The basic structure is characterized in that it furthermore comprises two loop elements, these loop elements respectively being formed from a flat woven fabric portion which has a first section of woven fabric type A and a second section of woven fabric type B, and wherein the first section is placed on the second section in such a way that the fold location is formed at a distance of less than 5 cm, in particular less than 1 cm, from the changeover location between woven fabric type A and woven fabric type B, and wherein the two flat woven fabrics are arranged above one another and the two loop elements are respectively arranged on a front end.

The basic structure therefore comprises at least four elements. The first flat woven fabric and the second flat woven fabric in this case usually represent the largest part of the basic structure. They are configured substantially as a homogeneous woven fabric and may advantageously be produced as roll goods independently of the dimension of the future clothing, and are correspondingly cut from the roll during the production of the clothing.

The changeover between woven fabric type A and woven fabric type B in the basic structure takes place at the fold location, as in DE102016111769. In contrast to this prior art, the basic structure of the present invention respectively comprises its own loop element, in which the folding takes place. These loop elements are substantially independent of the length of the future clothing, and may be produced and stored in standardized formats.

The basic structure may therefore be produced from elements which may be preproduced either as roll goods or as standardized loop elements. The invention nevertheless allows the flexibility of producing the two layers of the two-layer textile with different woven fabric types. Moiré effects may therefore be avoided or at least reduced, and the different requirements on the paper side and the backing side may be taken into account.

As described, in order to form a loop element, a flat woven fabric portion is folded. A fold location is therefore formed at one end of the loop element. The two front edges of the original flat woven fabric portion come to lie at the other end of the loop element. In this case, one front edge is of woven fabric type A and the other front edge is of woven fabric type B.

The first section and the second section may in this case have the same length. Often, however, it is advantageous for these two sections to have different lengths. The length ratio is preferably between 40%/60% and 30%/70%. In the case of a flat woven fabric portion having a length of for example 2 m, the first section may be 1.20 m long and the second section may be 0.80 m long.

The different lengths have the advantage that the front edges do not come to lie directly on one another in the future fold, but are offset.

The flat woven fabrics and flat woven fabric portions used are usually woven from threads which consist entirely or partially of a polymer material. Polyamides, polyesters or polyethylenes are usual in this case.

It is particularly advantageous that in the first loop element and/or the second loop element, the front edge of woven fabric type A is connected, in particular welded, to the first flat woven fabric and the front edge of woven fabric type B is connected, in particular welded, to the second flat woven fabric.

The connection of the loop elements to the first flat woven fabric and the second flat woven fabric leads to a continuous basic structure. On the one hand, the latter is easier for further processing to form a clothing. On the other hand, such a basic structure not only provides transverse stability but can also take up tensile forces.

It is highly expedient in this type of connection for exclusively woven fabric type A to be present on one side of the basic structure and for exclusively woven fabric type B to be present on the other side.

Such a connection is also referred to as a "join". In order to achieve a basic structure and a clothing with properties which are as homogeneous as possible, it is usually helpful for properties such as the permeability or thickness in the region of the join to be substantially matched to the properties outside this connection zone, so that they lie particularly in the range of between 80% and 120% of the corresponding values outside the connection zone. Possibilities for producing such joins are described, for example, in Document WO 2019/063518.

Furthermore, in the region of the fold locations of the loop elements, CD threads may advantageously be removed so as to form seam loops, in particular 3 to 8 CD threads being removed per fold location.

If such seam loops are formed on both sides of the two-layer textile, they may be fed into one another and connected by means of a pintle wire so that the basic structure, or the entire clothing, may be made endless.

In order to allow simple threading of the pintle wire, an inner diameter of the seam loops which is as large as possible is desirable.

In order to determine the inner diameter of a seam loop, the largest circle which can be fully inserted into the seam loop is determined. The diameter of this circle is then regarded as the inner diameter of the seam loop.

However, a diameter which is too large leads to very thick seam loops which may possibly produce markings in the fibrous material web. It has proven advantageous for the inner diameter of the seam loops to be between 0.8 mm and 2.2 mm, preferably between 1 mm and 1.6 mm.

The size of the inner diameter of the seam loop is influenced greatly by the number of CD threads which are removed to form the seam loops. The described advantageous inner diameter is usually achieved very simply by removing 3-8 CD threads. When removing only one or 2 CD threads, the seam loops will instead have a smaller diameter in many applications. When removing more than 8 threads, the risk arises that the diameter of the seam loops will be too great.

The loop inner diameter is also dependent on the yarn diameter of the MD threads. The range [0.8-2.2 mm] is in this case applicable particularly for MD threads with diameters of between 0.3 mm and 0.6 mm. Such MD threads are typical for basic woven fabrics of clothings for paper machines. With different yarn diameters, loop inner diameters outside the range specified are also conceivable.

It may furthermore be advantageous for CD threads ("special threads"), which are neither in woven fabric type A nor woven fabric type B, to be provided in direct proximity to the seam loops. These special threads may either already be woven into the flat woven fabric portion or may be added subsequently during the formation of the seam loops. Since the place where the seam loop will be positioned in the future loop element is already established for the loop elements when making the flat woven fabric portion—namely at the transition between woven fabric type A and woven fabric type B—weaving the special threads in already during the production of the flat woven fabric portion is readily possible. Examples of possible special threads are twines, multifilaments or threads with a non-round cross section, for example flat threads. Special threads may furthermore be provided in the form of absorbent threads. In particular, the special threads may correspond in material and shape to the rest of the CD threads of the woven fabric type, but by corresponding measures, we for example the addition of an absorber additive for light in a particular wavelength range—particularly in a section of the NIR range between 780 nm and 1200 nm. Such absorbent CD threads may be welded to the MD threads by means of laser transmission welding. They give a certain stability to the seam loops. Since MD threads—particularly when they consist of a polyimide—do not absorb the laser light, they are heated during the welding only by contact with the CD threads. In this way, their strength is not substantially compromised.

As an alternative or in addition, such special threads may also be provided at other locations of the flat woven fabric portions, or of the loop elements. Such special threads in the form of absorbent threads may be highly advantageous particularly at or in the immediate vicinity of the front edges. In this way, the connection of the loop elements to the flat woven fabrics by welding may be simplified. Here again, it has proven advantageous that the location where the join connection will be produced is already known for the seam loops during the weaving of the flat woven fabric portions. The—usually more expensive—special threads therefore need to be woven in only at the locations where they are actually required.

A woven fabric by weaving or otherwise providing individual marking threads or other special threads—in particular fewer than 10—into a woven fabric of woven fabric type A (or B) should in this case still be regarded as a woven fabric of woven fabric type A (or B).

Advantageously, it may be provided that the woven fabric types A and B may differ in at least one parameter, in particular a different weaving pattern or a different CD thread density. This allows particularly high flexibility in the design of the clothing. It is not, however, absolutely necessary. In alternative embodiments, it may also be provided that woven fabric type A is the same as woven fabric type B. Such basic structures are also possible according to one aspect of the present invention.

In many embodiments, it may be advantageous for the basic structure to comprise a plurality of flat woven fabrics of woven fabric type A and/or a plurality of flat woven fabrics of woven fabric type B. In particular, a basic structure may be constructed from six elements, namely two flat woven fabrics of each of woven fabric types A and B and two loop elements.

Preferably, it may be provided that woven fabric type A and/or woven fabric type B have an MD thread density of between 30% and 45%, in particular between 34% and 42%, especially between 36% and 40%.

Particularly preferably, the two woven fabric types have entirely or substantially the same MD thread density. The latter is advantageous on the one hand in terms of production technology. For instance, the flat woven fabric for the loop elements may be produced on a loom and the two woven fabric types may employ the same warp threads, which then provide the MD threads in the basic structure. At the changeover location between the two woven fabric types, the weaving pattern or the weft thread material may be modified relatively easily. Modification of the warp threads, however, is possible only with great difficulty. On the other hand, the seam loops which are formed by the MD threads at the fold locations may thereby also be inserted more easily into one another, so that the basic structure may more easily be made endless.

The (MD) thread density specifies the proportion of the width of the woven fabric which is taken up by (MD) threads.

For example, if 8 threads per cm are provided and a thread has a diameter of 0.4 mm, the thread density is (8*0.4)/10=32%.

The specified range of the MD thread density allows, on the one hand, reasonably simple feeding of the seam loops into one another. It should be borne in mind that in the region of this seam, the MD threads of the two seam loops lead to a loop density which corresponds to two times the MD thread density. With an MD thread density of 45%, this gives a loop density of 90%. This is already close to the maximum theoretical density of 100%. Loop densities even greater than 90% can be handled only with great difficulty and are therefore not advantageous. An MD thread density of less than 30%, on the other hand, is not critical in terms of the loop density. However, the properties of the woven fabric, for example tensile strength, usually suffer from this so greatly that the value should not usually be fallen below without risking other disadvantages.

Clothings for paper and pulp machines, and the basic structures thereof, are often subjected to a heat treatment in a so-called heatsetting process. Usually, the warp thread density in the finished clothing or basic structure is greater than that before the heatsetting because of the shrinkage process resulting therefrom. The specified intervals for the MD thread density are in this case advantageous for clothings before and after the heatsetting.

In respect of the clothing, the object is achieved by a clothing, in particular a seam felt, for a machine for producing or processing a fibrous material web, in particular a paper, cardboard or tissue web, wherein the clothing comprises at least one basic structure according to one aspect of the invention.

The clothing may furthermore comprise further components.

Often, the clothing is also provided with further elements, for example nonwoven overlays, additional woven elements, films or foam elements. This is dependent on the future use of the clothing formed in this way.

One or more layers of nonwoven fibers may be provided particularly on the side of the clothing which touches the fibrous material web. Furthermore, may also be provided on the backing side of the nonwoven fibers.

The nonwoven fibers are usually connected to the basic structure by needling. This is also advantageous in particular since the individual components of the basic structure are thereby also connected to one another, so that the strength of the clothing is increased further.

In respect of the method, the object is achieved by a method for producing a basic structure according to one aspect of the invention, wherein the method comprises the steps:

a) providing a first flat woven fabric of woven fabric type A and a second flat woven fabric of woven fabric type B, b) providing two flat woven fabric portions, which have a first section of woven fabric type A and a second section of woven fabric type B, and forming loop elements by laying the first section on the second section so that the fold location is formed at a distance of less than 5 cm, in particular less than 1 cm, from the changeover location between woven fabric type A and woven fabric type B, and c) arranging the first flat woven fabric and the second flat woven fabric above one another and the two loop elements respectively on a front end.

In advantageous embodiments, the method may also comprise the step:

d) connecting the loop elements to the first flat woven fabric and the second flat woven fabric in such a way that, in the first loop element and the second loop element, the front edge of woven fabric type A is connected, in particular welded, to the first flat woven fabric and the front edge of woven fabric type B is connected, in particular welded, to the second flat woven fabric.

When carrying out the method, it should be noted that the order of the method steps may optionally also be interchanged. For example, the connection of the loop elements, or of the flat woven fabric portions, to the first/second flat woven fabric is possible both before the folding and formation of the loop elements and afterwards.

Furthermore, one or more heatsetting steps are provided in advantageous embodiments of the method. Here, many variants may be envisioned.

For instance, the first flat woven fabric may be subjected to heatsetting before and/or after the provision in step a).

As an alternative or in addition, the second flat woven fabric may be subjected to heatsetting before and/or after the provision in step a).

As an alternative or in addition, the flat woven fabric portions from which the loop elements are formed may also be subjected to heatsetting before and/or after the provision in step b). For example, it may be advantageous for the woven fabric of the flat woven fabric portions to be preproduced in the form of roll goods and for these roll goods already to be subjected to heatsetting, i.e. before separating the individual flat woven fabric portions.

Further advantageous features of the invention will be explained with the aid of exemplary embodiments with reference to the schematic drawings.

DETAILED DESCRIPTION OF THE INVENTION

Figure 1A:
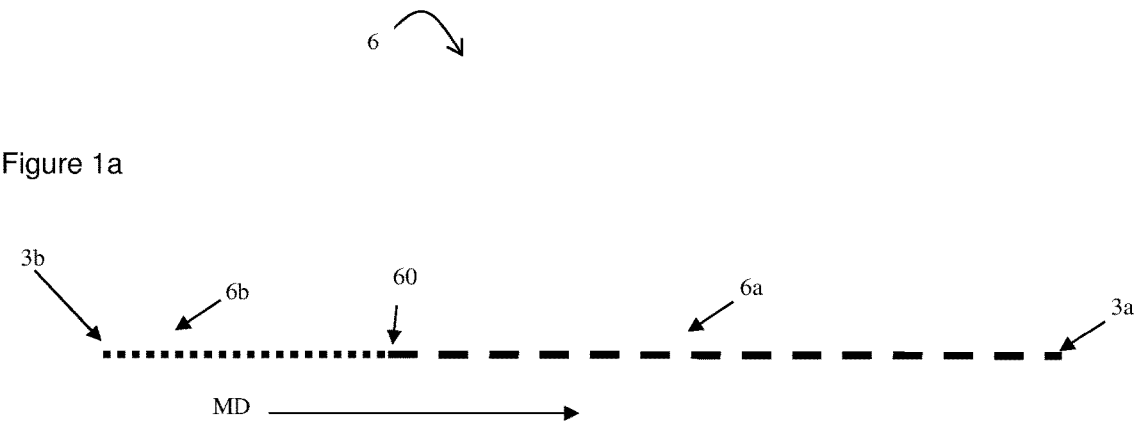
FIGS. 1*a* and 1*b* show a flat woven fabric portion, or a loop element, according to one aspect of the invention

FIG. 1*a* shows a flat woven fabric portion 6 which may be used as a basis for producing a loop element 2. The flat woven fabric portion 6 consists of a first section 6*a*, which is of woven fabric type A, and a second section 6*b*, which is of woven fabric type B. Woven fabric type A and woven fabric type B may advantageously be provided in that they differ in at least one parameter, in particular a different weaving pattern or a different CD thread density. In terms of production technology, it is highly advantageous for the two woven fabric types to have the same MD thread density. Sometimes, it may also be provided that woven fabric type A is the same as woven fabric type B.

In order to have high flexibility in the production of basic structures 1, or clothings, the flat woven fabric portion should have a short length in MD—compared with the basic structure. In particular, the flat woven fabric portion 6 may be configured to be shorter than 5 m, preferably 2 m or shorter.

The first section 6*a* and the second section 6*b* may in this case have the same length. Often, however, it is advantageous for these two sections 6*a*, 6*b* to have different lengths. The length ratio is preferably between 40%/60% and 30%/70%. In the case of a flat woven fabric portion 6 having a length of for example 2 m, the first section 6*a* may be 1.20 m long and the second section 6*b* may be 0.80 m long.

The different lengths have the advantage that the front edges 3*a*, 3*b* do not come to lie directly on one another in the future fold, but are offset.

Figure 1B:
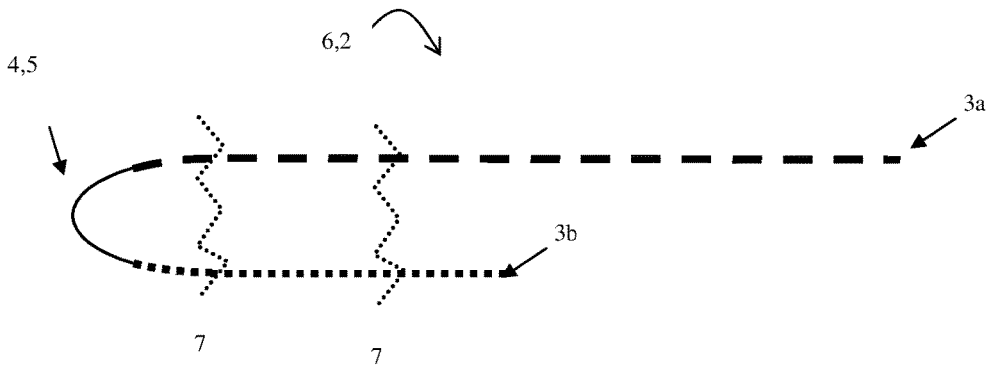

In order to form a loop element 2 from a flat woven fabric portion 6, the flat woven fabric portion may be folded and placed on itself. This is shown in FIG. 1*b*. The fold location 4 is in this case arranged in the region of the changeover location 60, in particular on the changeover location 60. In order to form seam loops 5, which serve for subsequently making the basic structure 1, or the clothing, endless, CD threads may be removed at the fold location. Often, it is sufficient to remove between 3 and 8 CD threads. The CD threads may in this case be removed from woven fabric type A and woven fabric type B. If, for example, the removal from one woven fabric type is more complicated than from the other, it is however also possible to remove CD threads from only one woven fabric type. If, as represented in FIG. 1*b*, the two sections 6*a*, 6*b* have different lengths, the front edges 3*a*, 3*b* do not come to lie on one another, which may be advantageous for the subsequent further processing.

The two layers of the loop element 2 may advantageously be connected to one another. Such connection may, for example, be carried out using one or more stitch connections 7. Such connection or stitching is advantageous inter alia since the two layers of the loop element 2 cannot be displaced relative to one another during the further processing.

Connection in the region of the seam loop 5, for example at a distance of less than 2 cm from the seam loop 5, may also be advantageous in order to fix the seam loop 5 and subsequently allow easier insertion of two seam loops 5 into one another in order to make the basic structure 1 endless.

Figure 2:
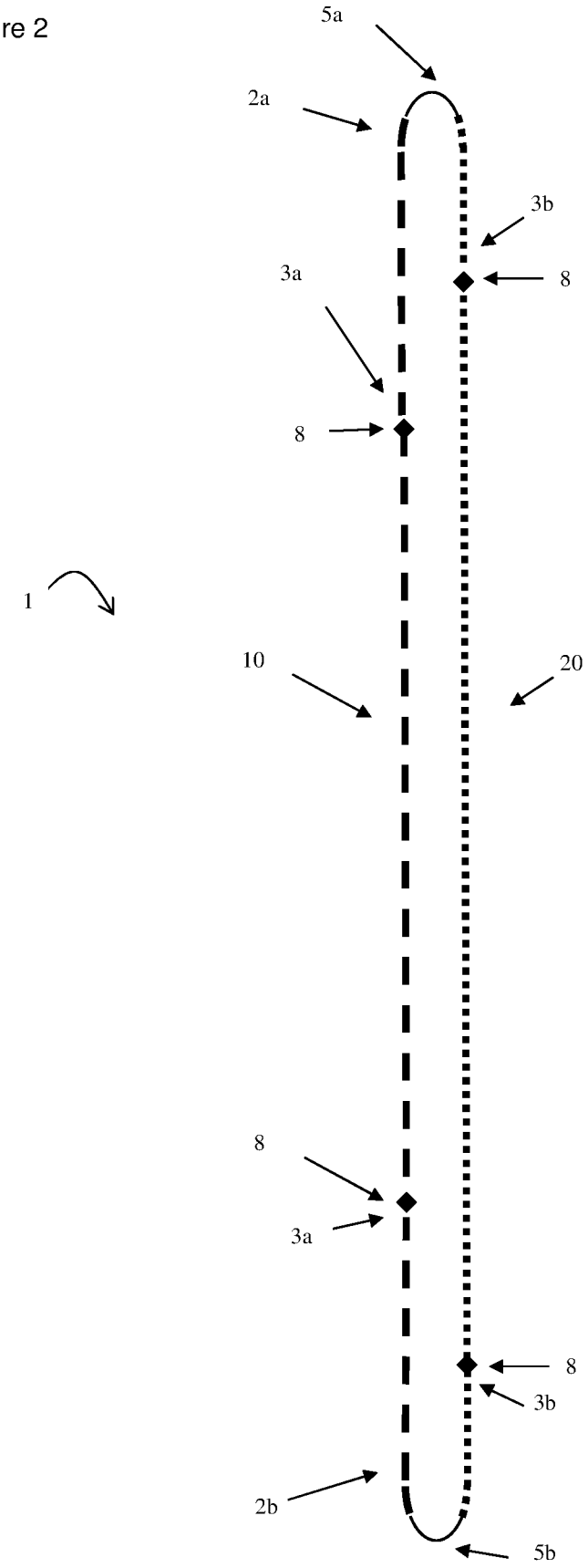
FIG. 2 shows a basic structure according to one aspect of the invention

FIG. 2 shows a basic structure 1 according to one aspect of the invention. This basic structure is formed from a first flat woven fabric 10 of woven fabric type A and a second flat woven fabric 20 of woven fabric type B, as well as two loop elements 2*a*, 2*b*. The loop elements 2*a*, 2*b* may in particular be configured as described in FIG. 1*a*, or 1*b*.

The first flat woven fabric 10 and the second flat woven fabric 20 are in this case arranged above one another. In a similar way as for the loop elements 2, 2*a*, 2*b*, these two layers 10, 20 may also be connected, in particular stitched, to one another. The stitch connections 7 are not represented explicitly in FIG. 2, but may nevertheless be present.

In order to form a continuous basic structure 1, the four components in FIG. 2 are connected to one another.

In this case, in the loop elements 2*a*, 2*b*, the front edge 3*a* of woven fabric type A is connected to the first flat woven fabric 10 and the front edge 3*b* of woven fabric type B is connected to the second flat woven fabric 20. This connection 8 may in particular be carried out in the form of a weld seam 8. The welding may for example be carried out by laser welding, in particular by laser transmission welding, or by ultrasound welding. As an alternative or in addition, the connection 8 may also be produced in the form of an adhesive connection or a stitch connection.

The basic structure 1 formed in this way has two seam loops 5*a*, 5*b*. By inserting these seam loops 5*a*, 5*b* into one another and subsequently inserting the pintle wire, the basic structure 1 may be made endless. Often, before making it endless (or afterwards), the basic structure 1 is also provided with further elements, for example nonwoven overlays, additional woven elements, films or foam elements. This depends on the future use of the clothing formed in this way.

Figure 2A:
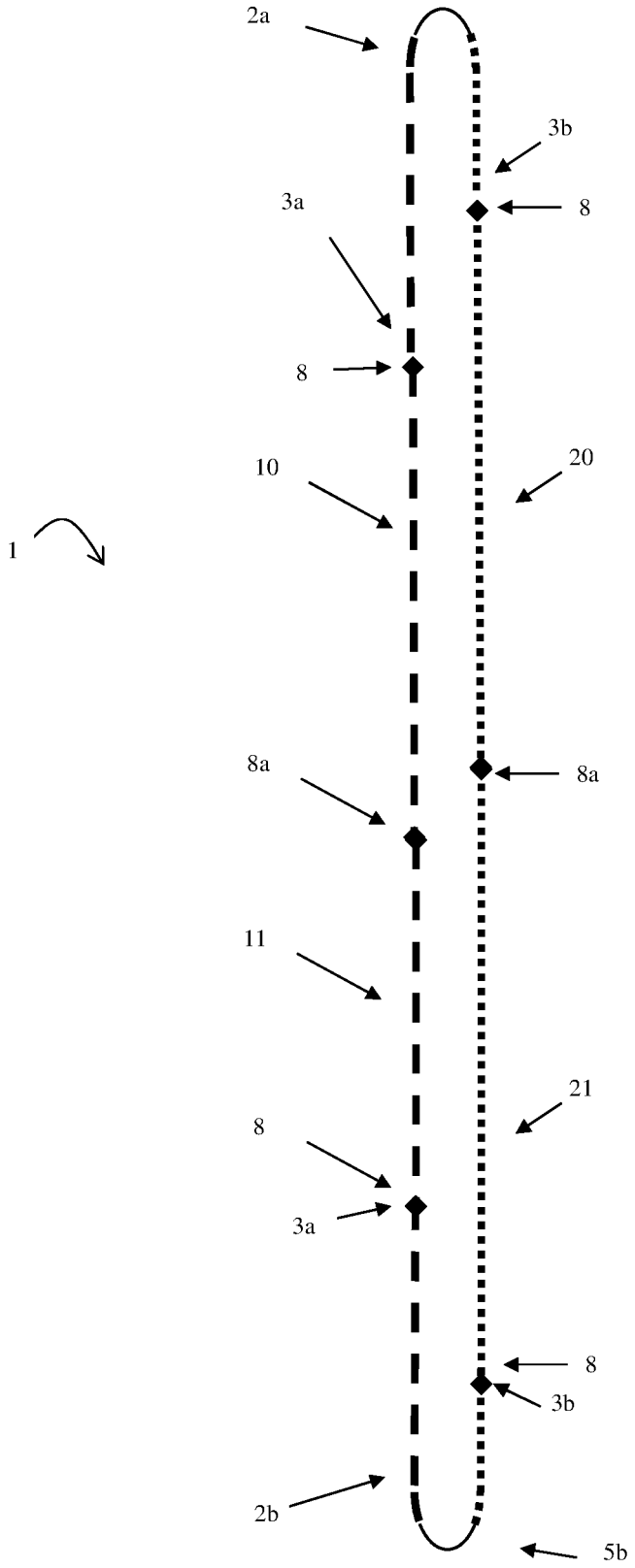
FIG. 2*a* shows a basic structure according to a further aspect of the invention

While a basic structure 1 consisting of four woven elements, as represented in FIG. 2, is generally advantageous, it is nevertheless possible and provided for that the basic structure may be constructed from more elements. An example of this is represented in FIG. 2*a*. The basic structure 1 indicated there differs from the basic structure 1 of FIG. 2 in that, in addition to the first flat woven fabric 10 and the second flat woven fabric 20, it comprises a further first flat woven fabric 11 and a further second flat woven fabric 21. The two flat woven fabrics respectively of the same woven fabric type may also be connected to one another in a suitable way, for example by means of a weld seam 8*a*. This may, for example, be advantageous if the flat woven fabric is not in the form of—quasiendless—roll goods, but of prefabricated woven fabric portions of fixed length. In such a case, in addition to the first (second) flat woven fabric 10 (20) and the further first (second) flat woven fabric 11 (21), even more flat woven fabrics may also be required in a similar way in order to construct the basic structure therefrom.

Figure 3:
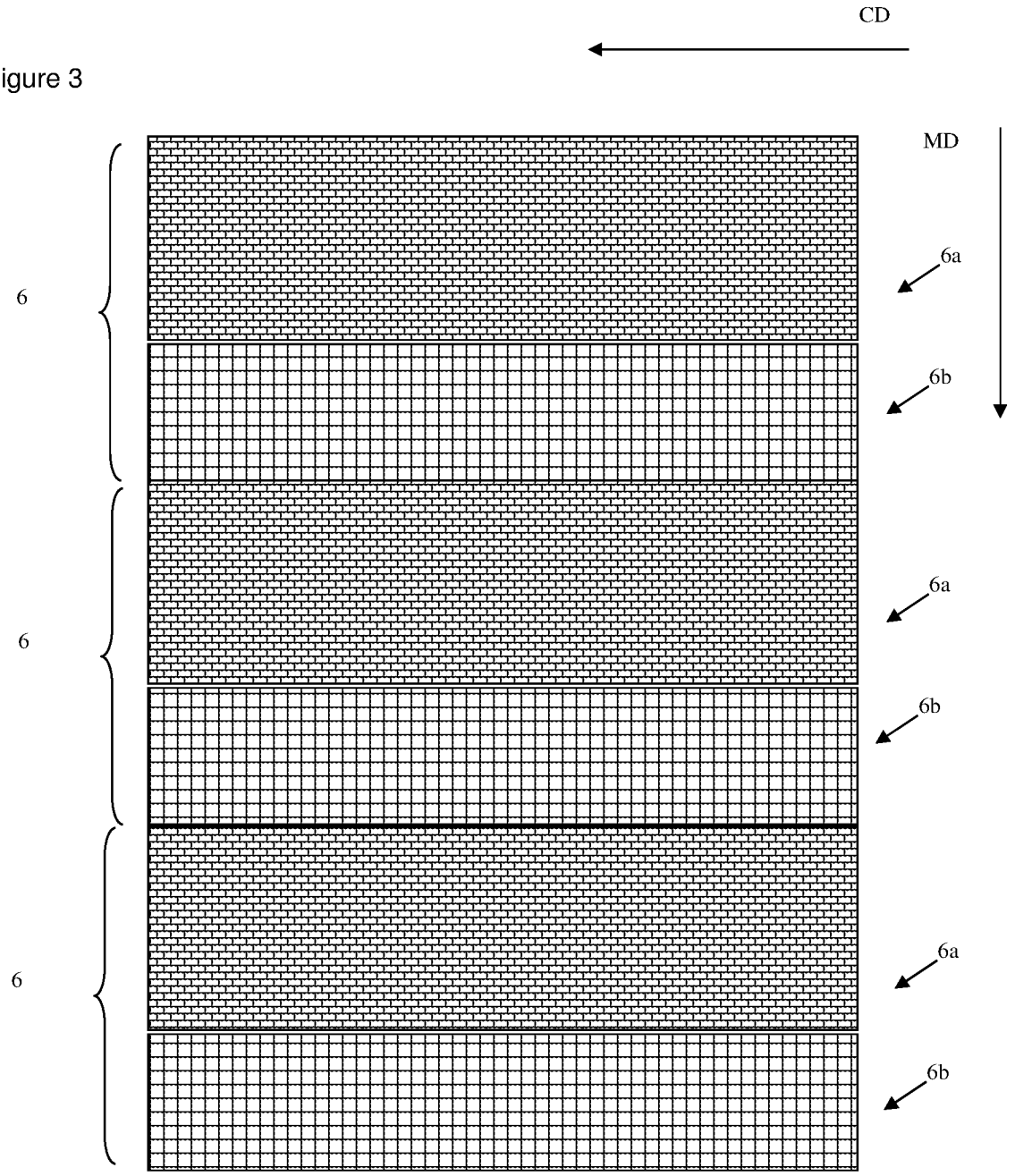
FIG. 3 shows a woven fabric for use in a method according to a further aspect of the invention

With reference to the example of FIG. 3, one of the advantages which clothings according to one aspect of the invention have will be explained again. By the separation of the loop elements 2, 2*a*, 2*b* from the flat woven fabrics 10, 20, it is possible to produce these woven parts of the basic structure 1 without knowledge relating to the dimension of the future clothing being required for this. In this regard, FIG. 3 shows a woven fabric, the weft direction of the loom corresponding to the CD direction of the future clothing, and the warp direction to the MD direction. In the CD direction, the woven fabric may be produced with the maximum width of the available loom, in order to be able to fulfil all width requirements of the future clothing as far as possible. If narrower clothings are desired, this may be achieved by corresponding trimming. The offcut thereby created also occurs in current production methods, and does not represent a specific disadvantage of the present concept.

In the MD direction, the woven fabric types A and B alternate in a regular pattern. This is based on the length of the flat woven fabric portions 6 subsequently required for the loop elements together with the desired length ratio of the woven fabric types A and B. For example, it may be provided that the flat woven fabric portions 6 have a length of 2 m, the first section 6*a* having a length of 1.2 m and the second section 6*b* having a length of 80 cm. The flat woven fabric portions 6 and the sections 6*a*, 6*b* may also be longer or shorter. In each case, the woven fabric of FIG. 3 may be preproduced as roll goods with the regular changeover of woven fabric types A and B. In order to produce a basic structure 1, two flat woven fabric portions 6 may be taken from this roll and loop elements 2, 2*a*, 2*b* may be formed therefrom. The length required for the specific order, or the basic structure 1, may then be set independently of the loop elements by a suitable length of the first flat woven fabric 10 and of the second flat woven fabric 20.

LIST OF REFERENCES

1 basic structure
2, 2*a*, 2*b* loop element
3*a*, 3*b* front edge
4 fold location
5 seam loop
6 flat woven fabric portion
6*a* first section
6*b* second section
7 stitch connection
8 weld seam
10, 11 first flat woven fabric
20, 21 second flat woven fabric
60 changeover location

The invention claimed is:

1. A basic structure of a clothing, the basic structure comprising:

at least one first flat woven fabric of woven fabric type A and at least one second flat woven fabric of woven fabric type B;

two loop elements respectively connected between said at least one first flat woven fabric and said at least one second flat woven fabric to form a continuous fabric structure including said at least one first flat woven fabric, said at least one second flat woven fabric and said two loop elements, said two loop elements being respectively formed from a flat woven fabric portion which has a first section of woven fabric type A and a second section of woven fabric type B;

said first section of woven fabric type A being laid on said second section of woven fabric type B to form a fold location at a distance of less than 5 cm from a changeover location between said woven fabric type A and said woven fabric type B; and said first flat woven fabric and said second flat woven fabric being arranged on top of one another and said two loop elements being respectively arranged on a front face end.

2. The basic structure according to claim 1, wherein said fold location is formed at a spacing distance of less than 1 cm from said changeover location.

3. The basic structure according to claim 1, wherein one or both of said two loop elements has a front edge of said woven fabric of type A connected said first flat woven fabric and a front edge of said woven fabric of type B connected to said second flat woven fabric.

4. The basic structure according to claim 3, wherein in a first and/or a second of said two loop elements said front edge of said woven fabric of type A is welded to said first flat woven fabric and said front edge of said woven fabric of type B is welded to said second flat woven fabric.

5. The basic structure according to claim 1, wherein in the region of said fold locations of said loop elements, cross machine direction threads are removed so as to form seam loops.

6. The basic structure according to claim 5, wherein 3 to 8 CD threads are removed from each fold location to form said seam loops.

7. The basic structure according to claim 1, further comprising cross machine direction threads ("special threads"), which are neither in woven fabric type A nor woven fabric type B, provided in direct proximity to said seam loops.

8. The basic structure according to claim 1, wherein said woven fabric types A and B differ in at least one parameter.

9. The basic structure according to claim 8, wherein said woven fabric types A and B have a different weaving pattern or a different CD thread density.

10. The basic structure according to claim 1, comprising a plurality of flat woven fabrics of woven fabric type A and/or a plurality of flat woven fabrics of woven fabric type B.

11. The basic structure according to claim 1, wherein at least one of said woven fabric type A or said woven fabric type B have a machine direction thread density of between 30% and 45%.

12. The basic structure according to claim 11, wherein said thread density of MD threads lies between 34% and 42%.

13. The basic structure according to claim 1 for a clothing of a machine for producing or processing a fibrous material web of paper, cardboard, or tissue.

14. A clothing for a machine for producing or processing a fibrous material web, the clothing comprising at least one basic structure according to claim 1.

15. The clothing according to claim 14 configured for a paper machine for producing or processing fibrous material web of paper, cardboard, or tissue.

16. The clothing according to claim 14, being a seam felt.

17. A method of producing a basic structure of a clothing of a machine for producing or processing a fibrous material web, the method comprising:

a) providing at least one first flat woven fabric of woven fabric type A and at least one second flat woven fabric of woven fabric type B;

b) providing two flat woven fabric portions, which have a first section of woven fabric type A and a second section of woven fabric type B, connecting the two flat woven fabric portions between the at least one first flat woven fabric and the at least one second flat woven fabric to form a continuous fabric structure, and forming loop elements by laying the first section of fabric type A on the second section of fabric type B to form a fold location at a distance of less than 5 cm from a changeover location between the woven fabric type A and the woven fabric type B; and c) arranging the at least one first flat woven fabric and the at least one second flat woven fabric above one another and the two loop elements respectively on a front end.

18. The method according to claim 17, which comprises forming the fold at a distance of less than 1 cm.

19. The method according to claim 17, further comprising:

d) connecting the loop elements to the at least one first flat woven fabric and the at least one second flat woven fabric in such a way that, in the first loop element and the second loop element, in each case a front edge of woven fabric type A connected to the first flat woven fabric and the front edge of woven fabric type B is connected to the second flat woven fabric.

20. The method according to claim 19, which comprises welding the front edge of woven fabric type A to the at least one first flat woven fabric and welding the front edge of woven fabric type B to the at least one second flat woven fabric.

* * * * *